US007789545B2

(12) United States Patent
Cheng et al.

(10) Patent No.: US 7,789,545 B2
(45) Date of Patent: Sep. 7, 2010

(54) VEHICLE HEADLIGHT ASSEMBLY

(75) Inventors: Yung-Tien Cheng, Tainan (TW); Liang-Ren Huang, Kaohsiung (TW); Chi-Ching Huang, Tainan (TW); Chen-Kang Hsu, Tainan (TW)

(73) Assignee: T.Y.C. Brother Industrial Co., Ltd., Tainan (TW)

( * ) Notice: Subject to any disclaimer, the term of this patent is extended or adjusted under 35 U.S.C. 154(b) by 172 days.

(21) Appl. No.: 12/108,841

(22) Filed: Apr. 24, 2008

(65) Prior Publication Data

US 2009/0279318 A1 Nov. 12, 2009

(30) Foreign Application Priority Data

Jan. 2, 2008 (TW) ..... 097100027

(51) Int. Cl.
*F21S 8/10* (2006.01)

(52) U.S. Cl. ..... 362/539; 362/511

(58) Field of Classification Search ..... 362/539, 362/560, 511, 507, 328, 516, 475
See application file for complete search history.

(56) References Cited

U.S. PATENT DOCUMENTS

2007/0230157 A1* 10/2007 Nagarekawa et al. ..... 362/34

FOREIGN PATENT DOCUMENTS

DE 3142475 A1 * 5/1983

* cited by examiner

*Primary Examiner*—Sharon E Payne
(74) *Attorney, Agent, or Firm*—Rosenberg, Klein & Lee

(57) ABSTRACT

A headlight assembly includes a housing, a light source, a light shielding plate, and a light guiding plate. The housing defines a compartment, and includes a reflector and a lens disposed in front of the reflector. The light source is mounted in the compartment and is disposed on an optical axis. The light shielding plate is mounted between the light source and the lens. The light guiding plate is disposed below the optical axis. A first portion of light beams emitted upwardly is reflected by the reflector, passes over the light shielding plate and through the lens, which refracts the first portion of the light beams to form a first illuminating pattern. A second portion of the light beams passes through the light guiding plate and through the lens, which refracts the second portion of the light beams to result in a second illuminating pattern that is directed forwardly and upwardly.

11 Claims, 6 Drawing Sheets

VEHICLE HEADLIGHT ASSEMBLY

CROSS REFERENCE TO RELATED APPLICATIONS

This application claims the benefit of Taiwan application serial number 097100027 filed Jan. 2, 2008, the disclosure of which is expressly incorporated herein.

BACKGROUND OF THE INVENTION

1. Field of the Invention

This invention relates to a headlight assembly, more particularly to a projector-type vehicle headlight assembly.

2. Description of the Related Art

A vehicle headlamp assembly is configured to provide road illumination to suit different road conditions and road visibility requirements. Currently, there exists a projector-type, or Poly-Ellipsoid System (PES) headlamp assembly. FIG. 1 shows a conventional headlamp assembly, which includes a reflector 61 that defines a compartment 610, a light source 62 mounted in the compartment 610 and disposed on an optical axis (x), a lighting shielding plate 63 extending upwardly from a bottom edge of the reflector and having a top edge that is flush with the optical axis (x), a housing (not shown) assembled in front of the reflector 61. By virtue of the shielding effect of the light shielding plate 63, the light beams reach and exit a region of the lens 64 that is below the optical axis (x). As a result, an illuminating pattern is formed. Even though the aforementioned vehicle headlamp assembly is capable of casting the illuminating pattern, the pattern cast thereby is heavily concentrated at a lower region (i.e., below the optical axis "x"), and causes an adjacent upper region (i.e., above the optical axis "x") to suffer from inadequate light illumination.

In order to adequately illuminate on upper region that is 18 meters in front of the headlamp assembly, the headlamp assembly must be able to provide at least 64 candela (cd) of light intensity thereat. However, the aforementioned conventional vehicle headlamp assembly does not have enough power to cast such light intensity, which is detrimental for drivers to be not able to discern the overhead signs when driving at nighttime.

As illustrated in FIG. 2, U.S. Pat. No. 6,736,533 discloses a vehicular headlamp that has an auxiliary plate 72 provided in front of a shield plate 71. The auxiliary plate 72 serves to reflect a portion of the descending light beams through a lens 73. As a result of passing through the lens 73, light beams A1 radiate forwardly in an upward direction so as to enhance overall light intensity in the upper region. Referring to FIG. 3, U.S. Pat. No. 6,736,533 further teaches another vehicular headlamp that has an aperture 810 in the shield plate 81, and an auxiliary plate 82 provided on an inner side of the shield plate 81. This particular configuration can also achieve the effect of enhancing light intensity in the upper region.

Another conventional headlight is disclosed in U.S. Patent Application Publication No. 2001/0019484, which discloses a screen configuration that permits limited upper region illumination.

SUMMARY OF THE INVENTION

The object of the present invention is to provide vehicle headlight assembly that can form two illuminating patterns.

According to the present invention, a vehicle headlight assembly includes a housing, a light source, a light shielding plate, and a light guiding plate. The housing defines a compartment, and includes a reflector and a lens disposed in front of the reflector. The light source is mounted in the compartment and is disposed on an optical axis. The light shielding plate is mounted in the housing between the light source and the lens. The light guiding plate is mounted in the housing and is disposed below the optical axis. A first portion of light beams emitted upwardly by the light source is reflected by the reflector, passes over the light shielding plate, and further passes through the lens, which refracts the first portion of the light beams to form a first illuminating pattern. A second portion of the light beams emitted by the light source passes through the light guiding plate and further passes through the lens, which refracts the second portion of the light beams to result in a second illuminating pattern that is directed forwardly and upwardly.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
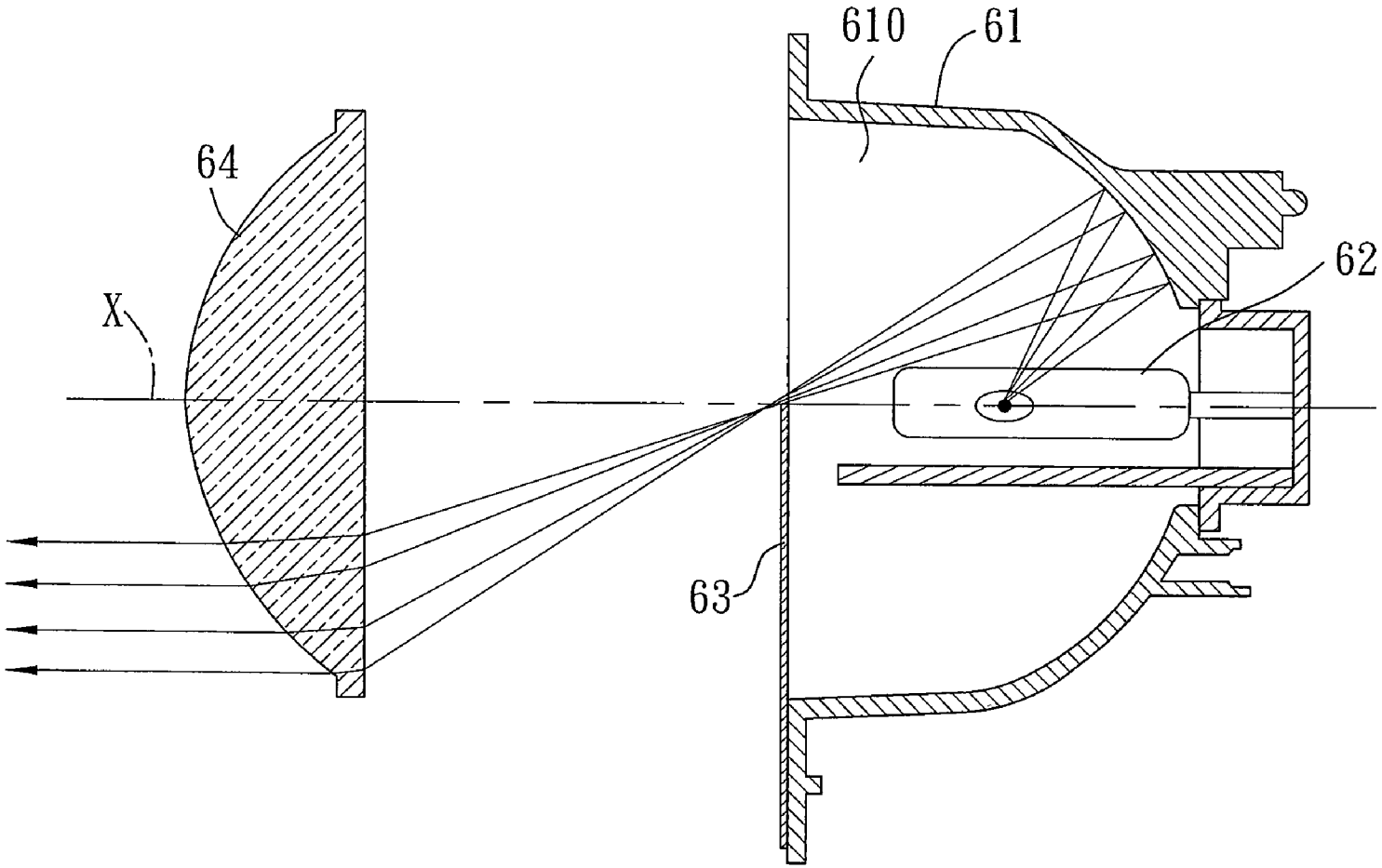
FIG. 1 PRIOR ART
FIG. 1 is a cross-sectional view of a conventional vehicle headlamp assembly.
Figure 2:
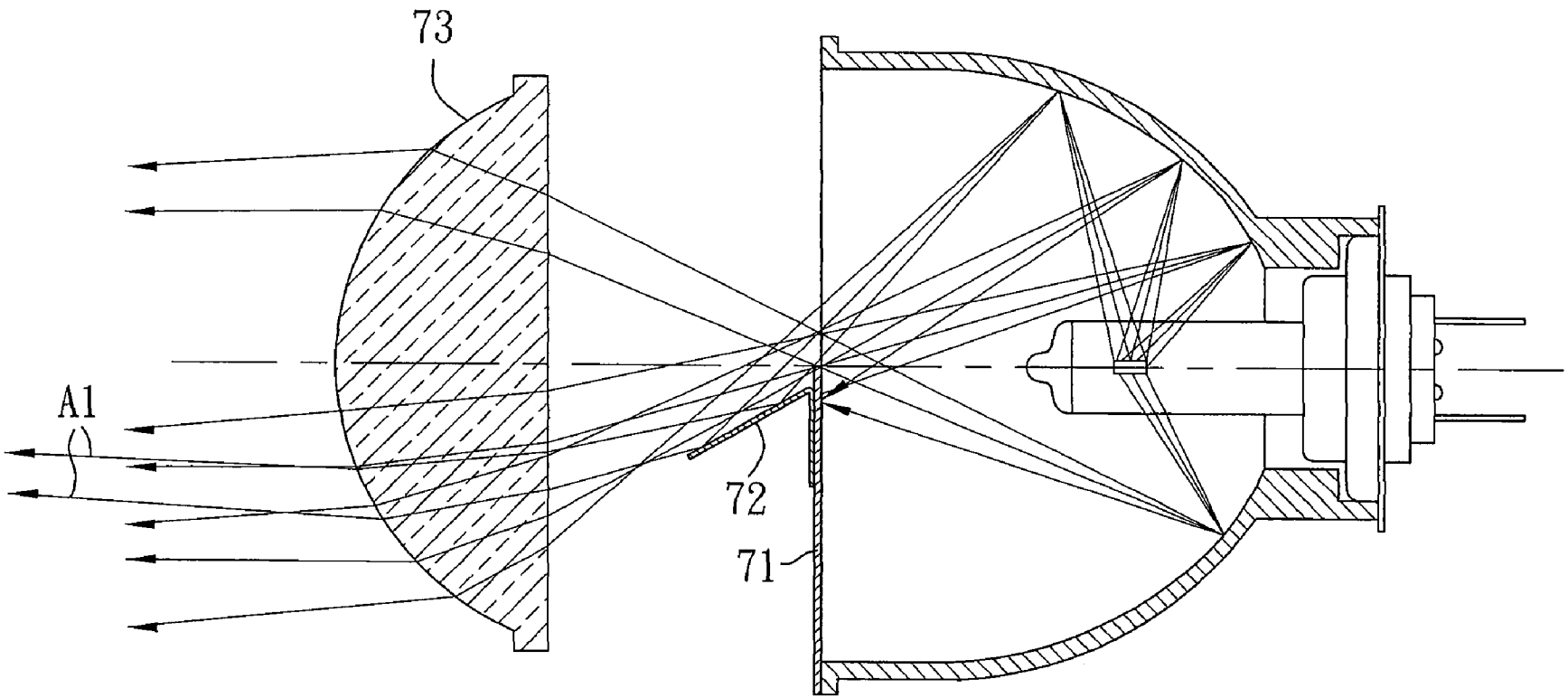
FIG. 2 PRIOR ART
FIG. 2 is a cross-sectional view of a conventional vehicle headlamp assembly disclosed in U.S. Pat. No. 6,736,533.
Figure 3:
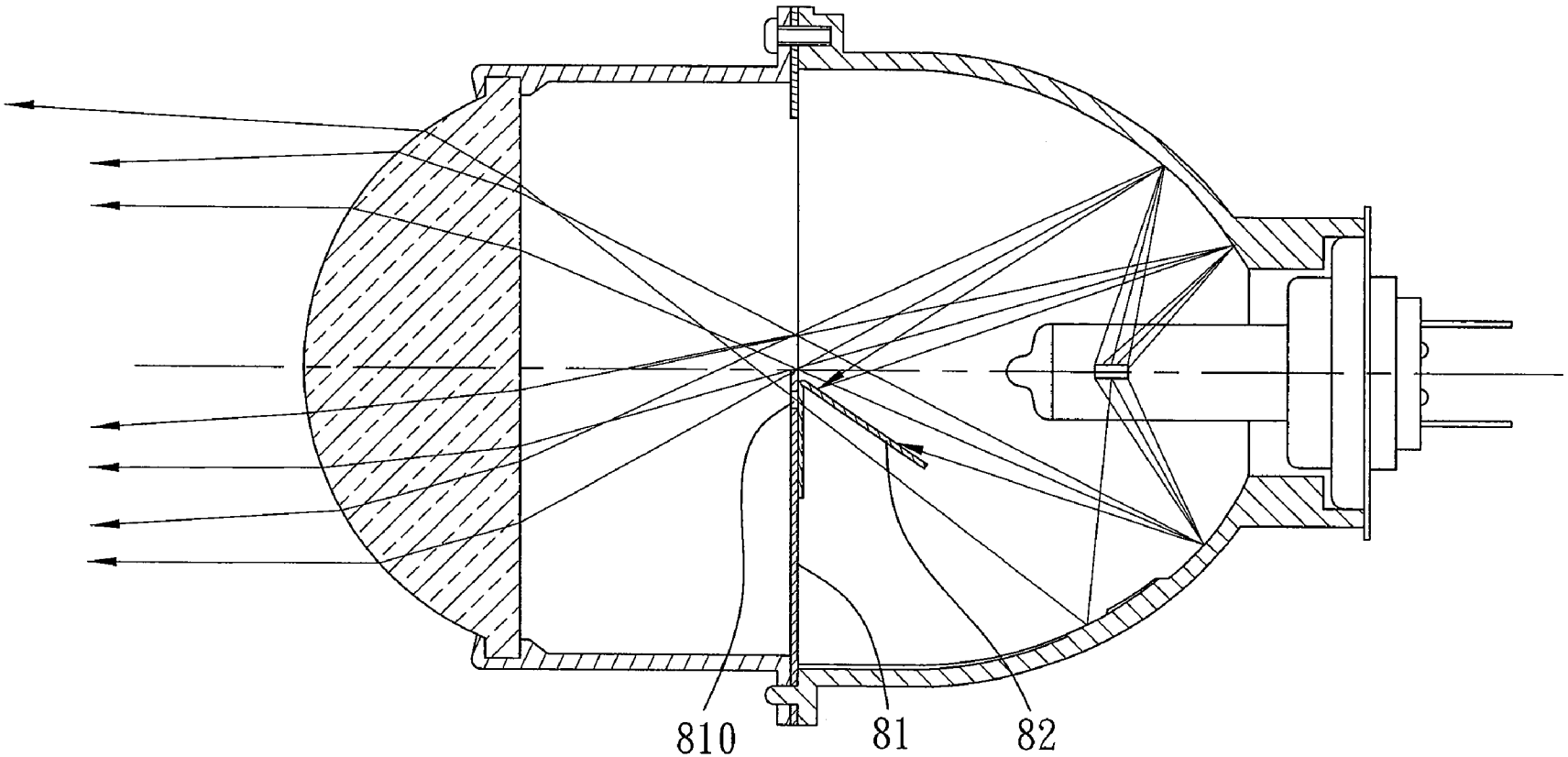
FIG. 3 PRIOR ART
FIG. 3 is a cross-sectional view of another vehicle headlamp assembly disclosed in U.S. Pat. No. 6,736,533.
Figure 4:
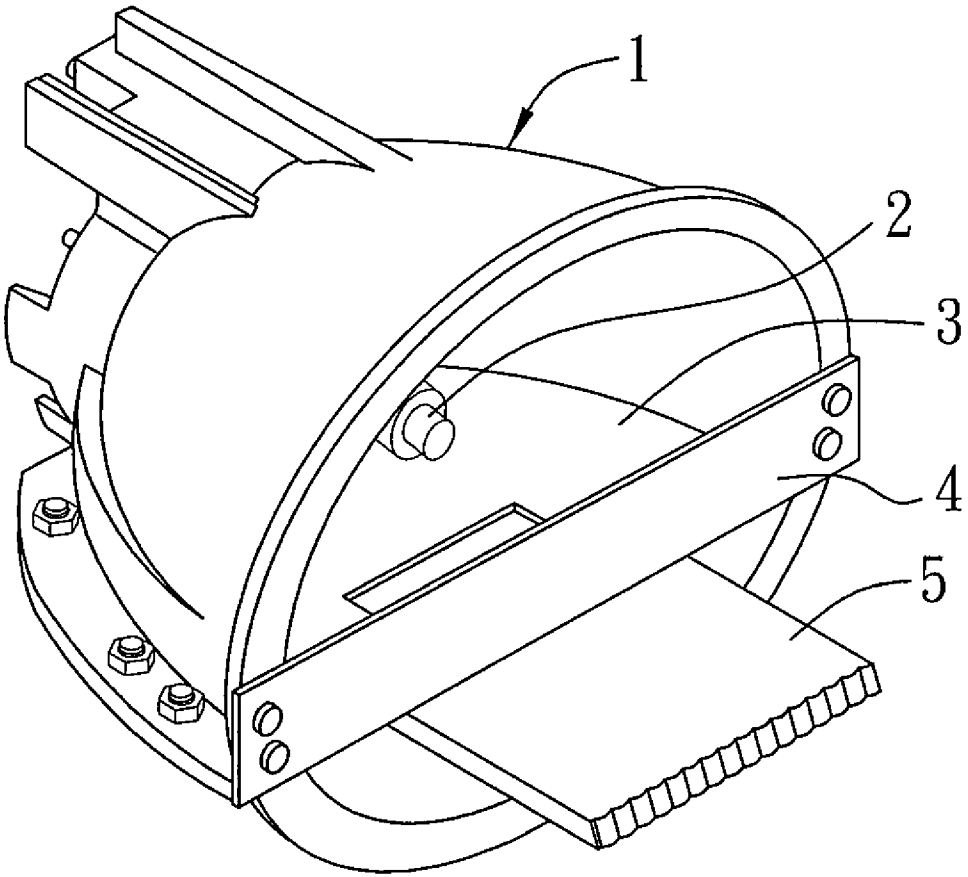
FIG. 4 is a perspective view of the preferred embodiment of a vehicle headlight assembly according to the present invention.
Figure 5:
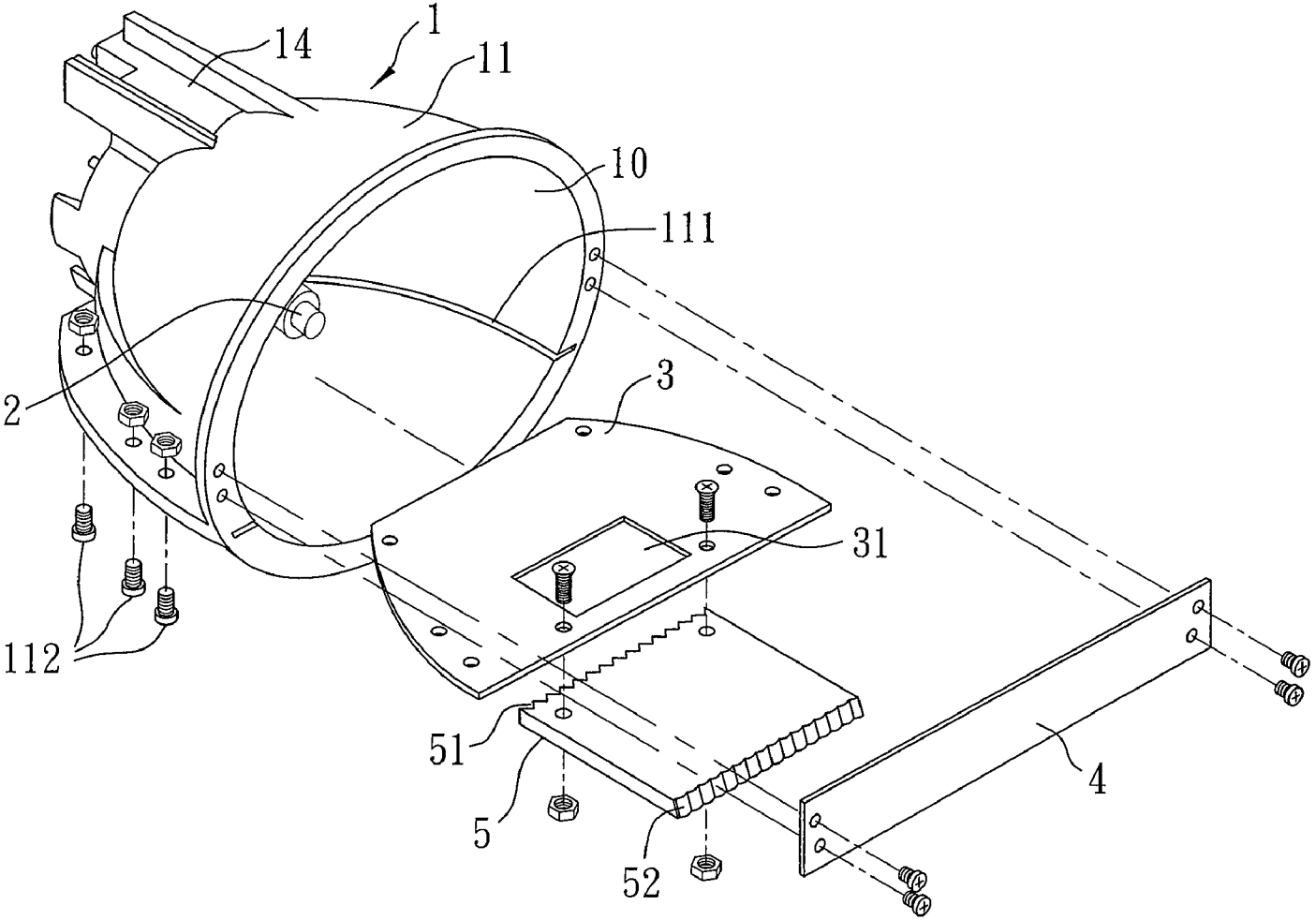
FIG. 5 is an exploded perspective view of the preferred embodiment.
Figure 6:
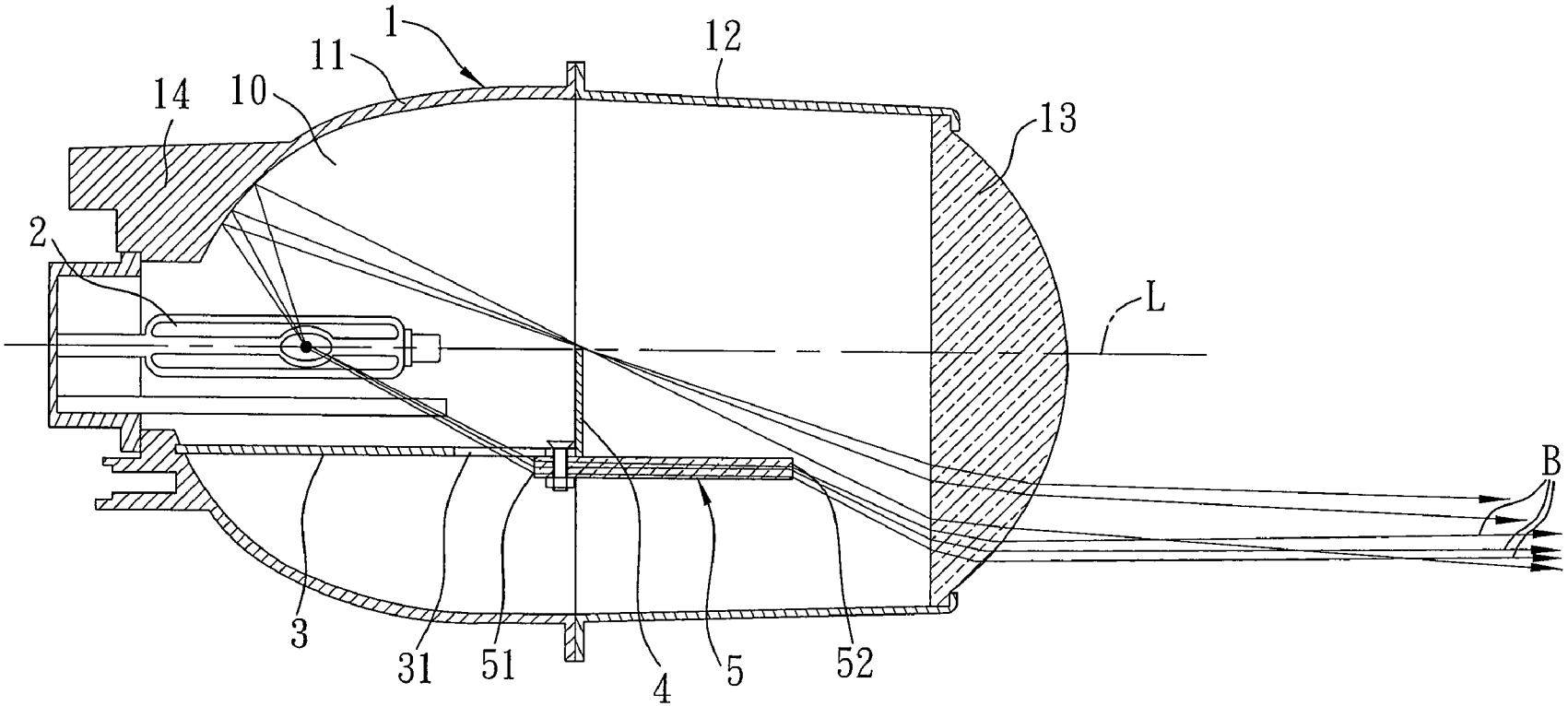
FIG. 6 is a cross-sectional view of the preferred embodiment.

Referring to FIGS. 4, 5, and 6, the preferred embodiment of a vehicle headlight assembly according to the present invention includes a housing 1, a light source 2, a heat-insulation plate 3, an elongated light shielding plate 4, and a light guiding plate 5. The housing 1 defines a compartment 10, and includes a reflector 11 and a lens 13 that is coupled to a lens holder 12 and that is disposed in front of the reflector 11. The light source 2 is mounted in the compartment 10 via mounting unit 14, and is disposed on an optical axis (L). The heat-insulation plate 3 is mounted in the housing 1 and is disposed below the light source 2. The light shielding plate 4 is mounted in the housing 1 between the light source 2 and the lens 13 and has opposite ends respectively fastened to the reflector 11. The light shielding plate 4 also has a top edge that is disposed at a same level as the optical axis (L). The light guiding plate 5 is mounted in the housing 1 and is disposed below the optical axis (L).

As shown in FIG. 6, a first portion of the light beams emitted upwardly by the light source 2 is reflected by the reflector 11, passes over the light shielding plate 4, and further passes through the lens 13, which refracts the first portion of the light beams to form a first illuminating pattern that is positioned below the optical axis (L). The first illuminating pattern is a low-beam illuminating pattern. On the other hand, a second portion of the light beams emitted by the light source 2 passes through the light guiding plate 5 and further passes through the lens 13, which refracts the second portion of the light beams to result in a second illuminating pattern (B) that is directed forwardly and upwardly. The light guiding plate 5 has a light incident surface 51 that faces toward the light source 2 and whereat the second portion of the light beams is incident, and a light exit surface 52 that is opposite to and spaced apart from the light incident surface 51 and that faces toward the lens 13.

In this embodiment, the heat-insulation plate 3 has upper and lower surfaces and a through-hole 31 formed through the upper and lower surfaces. The through-hole 31 allows the second portion of the light beams emitted by the light source 2 to pass therethrough and subsequently enter the light guiding plate 5. The light incident surface 51 is formed with saw-teeth protrusions, whereas the light exit surface 52 is formed with rounded protrusions. The light guiding plate 5 extends forwardly to the lens 13 with respect to the heat-insulation plate 3. In the preferred embodiment, the light guiding plate 5 is fastened to the heat-insulation plate 3 and is made of a plastic material but should not be limited thereto.

As shown in FIG. 5, the reflector 11 has inner and outer surfaces and is formed with a groove 111 that extends along a curve and that is indented from the inner surface toward the outer surface. The heat-insulation plate 3 is constructed to match the inner surface of the reflector 11. The heat-insulation plate 3 engages the groove 111 and is fixed to the reflector 11 by fasteners 112. The heat insulation plate 3 is utilized in the present invention to insulate heat radiated from the light source 2. It should be noted that the heat-insulation plate 3 can be omitted in other embodiments of the present invention.

In the conventional Poly-Ellipsoid System (PES)/headlight assembly, a portion of the descending light beams emitted by the light source 62 is blocked and is not utilized. However, in the present invention, due to the light guiding property of the light guiding plate 5, such descending light beams can be utilized for further illumination. That is, the light guiding plate 5 directs the descending light beams that were previously unusable into usable light beams for forming the second illuminating pattern. With this structure of the present invention, the light beams are effectively utilized so that the illuminating efficiency of the headlight assembly is thus maximized.

It should be noted that while the preferred embodiment of the headlight assembly is exemplified as a low beam light module, this invention can also be applied to other headlight assemblies, such as a high beam light module or an integrated low/high beam light module.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A vehicle headlight assembly comprising:

a housing defining a compartment and including a reflector and a lens disposed in front of said reflector;

a light source mounted in said compartment and disposed on an optical axis;

a light shielding plate mounted in said housing between said light source and said lens; and a light guiding plate mounted in said housing and disposed below said optical axis;

wherein a first portion of light beams emitted upwardly by said light source is reflected by said reflector, passes over said light shielding plate, and further passes through said lens, which refracts said first portion of the light beams to form a first illuminating pattern;

wherein a second portion of the light beams emitted by said light source passes through said light guiding plate and further passes through said lens, which refracts said second portion of the light beams to result in a second illuminating pattern that is directed forwardly and upwardly.

2. The vehicle headlight assembly as claimed in claim 1, wherein said light guiding plate has a light incident surface that faces toward said light source and whereat said second portion of the light beams is incident, and a light exit surface that is opposite to and spaced apart from said light incident surface and that faces toward said lens.

3. The vehicle headlight assembly as claimed in claim 2, wherein said light incident surface of said light guiding plate is formed with saw-teeth protrusions.

4. The vehicle headlight assembly as claimed in claim 2, wherein said light exit surface of said light guiding plate is formed with rounded protrusions.

5. The vehicle headlight assembly as claimed in claim 1, further comprising a heat-insulation plate mounted in said housing and disposed below said light source.

6. The vehicle headlight assembly as claimed in claim 5, wherein said reflector has inner and outer surfaces and is formed with a groove that is indented from said inner surface toward said outer surface, said heat-insulation plate engaging said groove.

7. The vehicle headlight assembly as claimed in claim 5, wherein said heat-insulation plate has upper and lower surfaces and a through-hole formed through said upper and lower surfaces, said through-hole allowing said second portion of the light beams emitted by said light source to pass therethrough and subsequently enter said light guiding plate.

8. The vehicle headlight assembly as claimed in claim 5, wherein said light guiding plate extends forwardly with respect to said heat-insulation plate.

9. The vehicle headlight assembly as claimed in claim 5, wherein said light guiding plate is fastened to said heat-insulation plate.

10. The vehicle headlight assembly as claimed in claim 1, wherein said light shielding plate has a top edge that is disposed at a same level as said optical axis.

11. The vehicle headlight assembly as claimed in claim 1, wherein said first illuminating pattern is a low-beam illuminating pattern.

* * * * *